US005195888A

United States Patent [19]

Sharma et al.

[11] Patent Number: 5,195,888

[45] Date of Patent: Mar. 23, 1993

[54] MULTI-LAYER FLUID CURTAINS FOR FURNACE OPENINGS

[75] Inventors: Sudhir K. Sharma, Stormville, N.Y.; Michael F. Riley, Danbury, Conn.; Mark S. Nowotarski; Alan R. Barlow, both of Stamford, Conn.

[73] Assignee: Praxair Technology, Inc., Danbury, Conn.

[21] Appl. No.: 746,750

[22] Filed: Aug. 19, 1991

[51] Int. Cl.[5] ..... F27B 7/00; F24F 9/00

[52] U.S. Cl. ..... 432/64; 432/115; 454/188; 454/190; 454/193

[58] Field of Search ..... 432/64, 115; 110/179; 454/188-193

[56] References Cited

U.S. PATENT DOCUMENTS

| | | | |
|---|---|---|---|
| 3,130,559 | 4/1964 | Beckwith | 454/193 |
| 3,163,024 | 12/1964 | Beckwith et al. | 454/193 |
| 3,350,994 | 11/1967 | Guibert | 454/190 |
| 3,706,138 | 12/1972 | Schuierer | 432/115 |
| 3,713,401 | 1/1973 | McClurkin | 107/57 B |
| 4,823,680 | 4/1989 | Nowotarski | 98/36 |
| 4,840,046 | 6/1989 | Fung | 454/193 |
| 4,894,009 | 1/1990 | Kramer et al. | 432/64 |
| 4,898,319 | 2/1990 | Williams | 228/219 |
| 4,989,501 | 2/1991 | Catan | 454/188 |

FOREIGN PATENT DOCUMENTS 36-7228 6/1961 Japan .

OTHER PUBLICATIONS

Townsend, Section 10, "Turbulence", pp. 10-30 to 10-31 in *Handbook of Fluid Dynamics*, 1961.

*Primary Examiner*—Henry C. Yuen

*Attorney, Agent, or Firm*—Peter Kent

[57] ABSTRACT

An apparatus and method for providing a selected atmosphere at and within an opening to the interior volume of a furnace. Two or more paralleled diffusers adjacent to the furnace opening laminarly emit different fluids and provide a multi-layer fluid curtain over the opening. The curtain has a composite modified Froude number from 0.05 to 10, and a thickness at emission of at least 5% of its extent in the flow direction. Partially covering the outside of the curtain is an optional, substantially flat, outer shield with an aperture coinciding with the furnace opening, which reduces the necessary flow rates of fluids. Optional side shields around the sides of the curtain also reduce the necessary fluid flow.

A preferred diffuser comprises a porous tube in a housing with an outlet directed to emit fluid across the furnace opening. The outlet is covered with a screen to disperse the fluid flow and to protect the porous tube.

28 Claims, 6 Drawing Sheets

MULTI-LAYER FLUID CURTAINS FOR FURNACE OPENINGS

TECHNICAL FIELD

The present invention relates to providing a selected atmosphere within a contained volume, particularly the free working volume of a heating or melting furnace. The atmosphere is provided by a multi-layer fluid curtain flowing across an opening to the volume to impede the infiltration of atmospheric air into the volume through the opening and to provide the selected atmosphere within the volume.

BACKGROUND

Metal melting furnaces are used to produce refined metal and metal alloys such as steel, stainless steel, nickel, cobalt, aluminum, and so forth. An electric induction furnace is an example of such a furnace. A metal melting furnace has an interior volume for containing the charge to the furnace. The interior volume is initially charged with unmelted scrap. After melting the initial charge, typically, but not necessarily, the interior volume is incompletely filled with molten metal, leaving some free interior volume which is occupied principally with atmospheric air, unless another atmosphere is provided.

Access to the furnace interior volume is desired during the melting period to visually inspect the progress of the melting and to withdraw samples of the melt. Access is also desired to add constituents to the charge as the melting progresses to adjust the melt to the required composition of alloy.

Molten metals react with, dissolve and absorb atmospheric air in varying degrees causing oxidation, slag formation and compositionally unsatisfactory product. The results are poor metal properties, poor casting quality, decreased yields and increased production cost.

To circumvent this problem, cover lids are used to restrict the infiltration of atmospheric air into the interior volume of the furnace. Sometimes an inert gas may also be introduced under the lid to reduce or further restrict infiltration of air. Such cover lids, however, block physical and visual access to the furnace opening and are infrequently used by operators.

Another approach has been to introduce a protective gas through a conduit directly into the free volume of the furnace. However, large volumes of protective gas are required which can be expensive depending on the protective gas used.

Still another approach has been to introduce a liquified protective gas onto the surface of the melt. This approach has the danger of metal explosion if liquid gas becomes trapped below the surface of the melt. Also the oxygen concentrations developed in the free interior furnace volume are undesirably high for the amount of liquified gas used.

Yet another method is to provide a single layer fluid curtain or jet of protective gas across the opening to the furnace. Concurrently a flow of protective gas may be introduced directly into the free furnace volume as a supplementary purge. The use of a turbulent jet or single layer curtain is wasteful of protective gas in comparison to the multi-layer curtain employed in this invention.

The prior art describes the generation of a fluid curtain by issue of fluid from slots, nozzles, and porous surfaces. The present invention provides a novel device for the generation of a fluid curtain which has greater capability of excluding atmospheric air from entering an opening.

SUMMARY OF THE INVENTION

Accordingly it is an objective of the present invention to provide an improved method and apparatus to prevent atmospheric reaction with and contamination of the products of metal melting furnaces and the like.

It is a feature of this invention to emit a multi-layered fluid curtain across an opening to the free interior volume of a furnace to provide a selected atmosphere within the free volume and to impede atmospheric air from entering the opening.

It is a feature of this invention that the apparatus to generate the fluid curtain is geometrically simple and functionally efficient.

It is an advantage of this invention that the opening is unobscured and that the consumption of protective gas relative to other methods of providing a selected atmosphere in the free furnace volume is reduced.

Another advantage is that a low density gaseous atmosphere can be maintained in the free furnace volume with minimal consumption of the low density gas by using a curtain with a low density inner layer and a higher density outer layer.

Yet another advantage is that a flammable atmosphere can be maintained in a free volume while a nonflammable plume emanates therefrom.

This invention provides an apparatus and method for providing a selected atmosphere across an opening to, and within a contained volume, such as the interior free volume of a furnace. The apparatus comprises an inner diffuser for mounting near at least a portion of the perimeter of the opening. The inne. diffuser laminarly emits an inner layer of fluid so as to flow over at least a portion of the opening, enter and purge the volume and substantially provide the selected atmosphere at the opening and within the volume.

Further comprising the apparatus is an outer diffuser for mounting adjacent to the inner diffuser. The outer diffuser laminarly emits an outer layer of fluid to flow in the same approximate direction as the inner layer so as to extend over at least a portion of the inner layer and impede the infiltration of surrounding air into the inner layer. The two layers act cooperatively to stabilize the laminar flow in each layer over a longer distance thereby extending the effective area of coverage of the layers.

The inner and outer diffusers have fluid emitting openings or surfaces with a composite height at least 5% of the distance over which the layers are intended to flow. The apparatus includes means for controlling the inner layer fluid flow and means for controlling the outer layer fluid flow so that the fluids are emitted at a composite, nondimensionalized flow rate, i.e., a composite modified Froude number, within the range of from about 0.05 to about 10.

In another embodiment, three or more diffusers are stacked so as to provide a curtain of three or more layers.

In another embodiment, an outer shield covers the outer surface of at least a portion of the outer curtain. The outer shield has an opening at least partially coinciding with at least a portion of the furnace opening to provide at least partial visual and physical access to the furnace opening.

In yet another embodiment, side shields cover the sides of the fluid curtain.

This invention also provides an improved diffuser for emitting a laminar fluid curtain. The diffuser comprises a hollow tubular body having an inlet for fluid and a perforated wall for emitting fluid in laminar flow. A housing encloses the perforated body and has an outlet extending substantially the length of the tubular body. The housing directs fluid across the opening to the volume provided with a selected atmosphere. In a preferred embodiment, a screen across the housing outlet disperses the flow from the outlet and protects the tubular body from molten metal splatter.

DETAILED DESCRIPTION OF THE INVENTION

Figure 1:
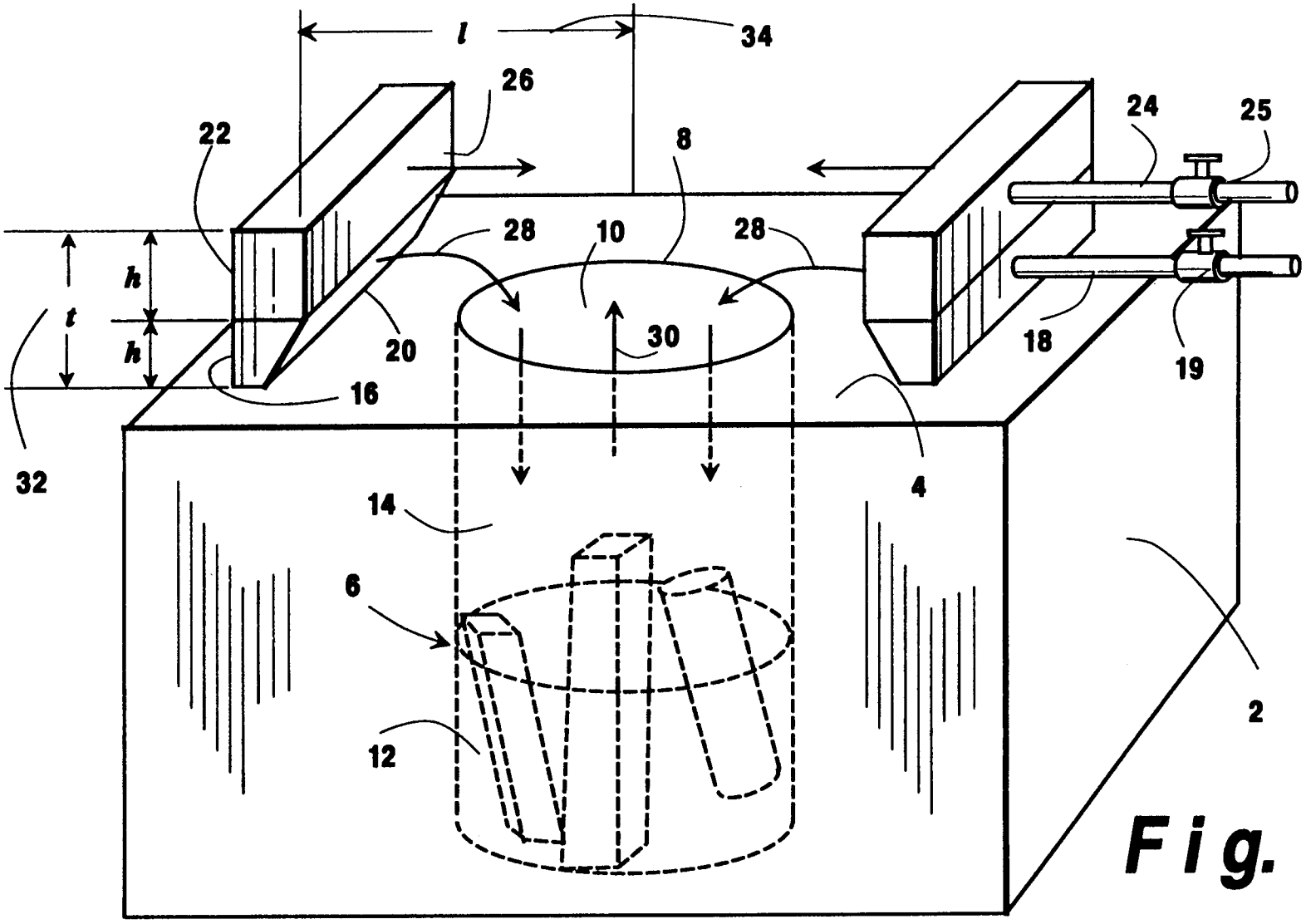
FIG. 1 is a pictorial view of a furnace with apparatus embodying the invention.

While this invention has many applications for providing a selected atmosphere within a contained volume, it will be described with regard to its application on a metal melting furnace such as an electric induction furnace. Depicted in FIG. 1 is a melting furnace having a body 2 with an upper deck 4 and an interior volume or chamber 6 for receiving and melting the charge. The chamber is generally cylindrical and has a circular perimeter 8 within the deck which forms an opening 10 to the chamber 6.

Typically when the furnace is in use, the chamber 6 has an occupied volume 12 containing the unmelted charge and melt, and a free volume 14 containing a vaporous atmosphere comprised of air and vapors from the melt. The chamber 6, however, may be completely filled so that the free volume 14 is zero. In this event, the method and apparatus of the invention are applicable in providing a selected atmosphere on the surface of the charge in the furnace chamber.

Near the perimeter 8 of the opening 10 on the deck surface 4 rest two inner diffusers 16 positioned diametrically opposite each other across opening 10. In operation, from each inner diffuser 16, fluid 28 emanates forming an inner fluid layer which extends half way across the opening 10. Optionally, a single inner diffuser 16 on only one side of the opening 10 could be employed to provide an inner fluid layer extending entirely across the opening.

A diffuser 16, as shown in FIG. 1, comprises a linear, elongated box typically having a length equal to, or somewhat greater than, the diameter of the opening being protected. Each diffuser is provided with a fluid inlet 18 connected to a means 19 for controlling the fluid flow and a source of pressurized inner layer fluid. Each diffuser has an emitting area 20 which is a free opening or an opening covered by a porous, permeable or perforated surface. The emitting area 20 emits laminarly an inner layer of fluid to flow over at least a portion of the furnace opening so as to enter and purge any free volume of the furnace and substantially provide a selected atmosphere within any free interior volume of the furnace. Laminar flow is considered to exist when the root mean square of random fluctuations in fluid velocity does not exceed 10% of the average fluid velocity.

The inner diffuser 16 may be oriented to emit the inner layer of fluid parallel to the furnace opening 10 or the inner diffuser 16 may be oriented to direct the layer into the furnace opening 10. In FIG. 1, the porous faces 20 of inner diffusers 16 are oriented to emit fluid layers into the opening 10. An acute angle of up to 30 degrees into the opening is useful.

While the inner diffuser or diffusers may be located at or very close to the perimeter of an opening to a furnace chamber, diffusers are preferably located a short distance from the opening perimeter so as to minimize the amount of molten metal splatter which may reach and impair the emitting surface of a diffuser.

Positioned on each inner diffuser 16 is an outer diffuser 22, which may be of similar construction to the inner diffuser 16, namely, an elongated box with a fluid inlet 24 and an emitting area 26 which is a free opening or an opening covered by a porous, permeable or perforated surface. A preferred emitting surface is a porous metal surface with a pore size of from about 0.5 microns to about 100 microns, most preferably from about 2 microns to about 50 microns. The fluid inlets 24 are connected to a means 25 for controlling the fluid flow and a source of pressurized outer layer fluid. The outer diffuser emits laminarly an outer layer of fluid to flow in the same approximate direction as the inner layer. The outer layer extends over at least a portion of the inner layer thereby impeding the infiltration of air into the inner layer. Usually it also contributes to the atmosphere in the furnace free volume. The two layers act cooperatively to stabilize the laminar flow in each layer over a longer distance thereby extending the effective area of coverage of the layers.

In FIG. 1, the outer diffuser emitting surface 26 is directed to emit a fluid layer parallel to the opening 10 of the furnace. However, the emitting surface of the outer diffuser may be directed at an acute angle of as much as 30 degrees into or away from the opening of the furnace.

The gap between the inner surface of the inner diffuser and the furnace deck surface is minimized so as to minimize the infiltration of air through the gap. A seal between the inner diffuser and furnace deck surface is desirable in order to minimize such air infiltration. Also, a minimum gap between the outer and inner diffuser, or a seal is desirable to prevent the infiltration of air between the inner and outer diffusers.

As shown in FIG. 1, some of the inner layer fluid 28 enters the free volume 14 in the furnace around the perimeter 8 of the opening 10. The fraction of the inner layer flow which enters the free volume increases with the density of the inner layer fluid employed. The fluid which enters the free volume 14 is heated and establishes a flow 30 which rises upwards and outwards at the center of the free volume 14. The outer layer flows over the perimeter of the opening to the furnace and then upward and outward away from the furnace opening, thereby impeding the infiltration of air into the inner layer.

To provide an effective curtain of flowing fluid, the composite emitting height 32 of the diffusers is at least 5% of the distance 34 over which the curtain is intended to flow. In addition, it is preferable that at least one of the inner and outer diffusers individually have an emitting height at least 5% of the distance over which the curtain is intended to flow.

An inner and an outer diffuser thus comprise a dual diffuser and produce a dual layer curtain. Another embodiment comprises three or more diffusers stacked to issue a curtain of three or more layers. The linear segments of diffusers shown in FIG. 1 may be supplemented by additional linear segments positioned around the perimeter of the opening. Alternatively, a diffuser may take the form of an annulus encircling at least a part of or the entire furnace opening.

In a common application where reduced oxygen concentration is desired and high nitrogen concentration is acceptable, the inner layer may be nitrogen gas and the outer layer may be air. The nitrogen inner layer purges the free volume and provides a selected atmosphere of reduced oxygen concentration in contact with the molten metal. The outer air layer reduces the consumption of nitrogen required for the inner layer and reduces the cost of the gas for the operation of the furnace.

Figure 2:
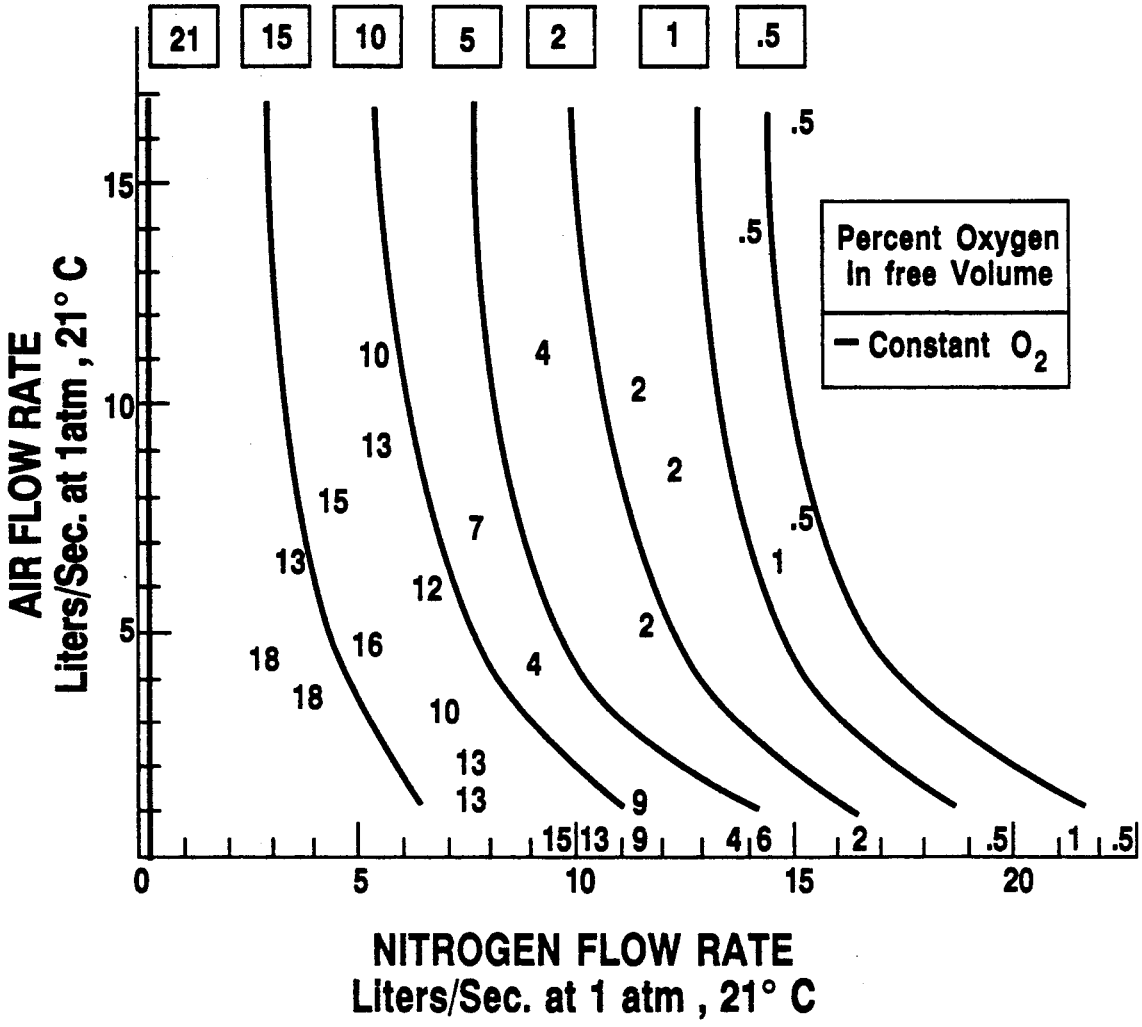
FIG. 2 is a graph of oxygen concentrations in a free furnace volume having an opening protected by a dual layer curtain with varying volumetric rates of flow of an outer layer comprised of air and an inner layer comprised of nitrogen gas.

FIG. 2 shows the resulting oxygen content within the free volume of a furnace protected by a pair of dual diffusers as a function of the nitrogen flow rate through the inner diffuser and the air flow rate through the outer diffuser. The diffusers are linear segments 30 cm long with porous emitting surfaces 2.5 cm high. They are spaced 37 cm apart and are directed to provide curtains over a 23 cm diameter opening to an interior free volume. By altering the size of the inner diffuser emitting surface relative to that of the outer diffuser, and by altering the rate of fluid delivery through the inner diffuser relative to the outer diffuser, the oxygen content within the free volume is adjustable over a large range.

From FIG. 2 it may be noted that to maintain an atmosphere of 0.5% oxygen in the free interior furnace volume, an outer layer air flow of 10 liters/second allows 30% reduction in inner layer nitrogen flow relative to that required with no outer layer flow. Thus the dual layer curtain provides a cost savings over a single layer curtain of nitrogen.

In cases in which it is desirable to provide within the free volume of the furnace a selected atmosphere which has reduced nitrogen content as well as reduced oxygen content relative to atmospheric air, an inner layer gas other than nitrogen is used. Such gas may be selected from, but is not restricted to argon, helium, hydrogen, carbon dioxide, carbon monoxide and mixtures thereof. A particularly useful combination is an inner layer comprised of argon and an outer layer comprised of air or nitrogen. A desired oxygen content and nitrogen content in the interior free volume of the furnace is provided by appropriate flows of argon and the selected outer layer gas. The use of an outer layer allows a reduction in the consumption of argon. Thus the use of a dual layer curtain where the inner layer is argon and the outer layer is nitrogen or air is more economical than the use of a single layer curtain of argon because argon is more costly than nitrogen or air.

A dimensionless parameter which is useful as a criterion of dynamic similarity for fluid curtains is a modified Froude number. This parameter is analogous to a nondimensionalized or normalized flow velocity, and can be used to describe the requirements for establishing an effective fluid curtain. The modified Froude number F as used herein is defined for a dual layer curtain as:

$$F = \frac{Q}{A}\sqrt{\frac{\rho_e}{(\rho_a - \rho_v)gt}}$$

where Q is the total volumetric flow rate of fluids provided to the diffusers to establish the dual layer curtain, A is the area covered by the dual layer curtain, $\rho_e$ is the mass flow-weighted average of the density of the fluids emitted by the diffusers, $\rho_a$ is the density of the atmospheric air contiguous with the curtain, $\rho_v$ is the density of the gas within the free volume of the furnace, g is the acceleration of gravity, and t is the composite thickness of the dual layer curtain at its origin. To calculate $\rho_e$, the average density of fluid emitted by the diffusers, the inner layer flow $W_i$, multiplied by its density $\rho_i$, and the outer layer flow $W_o$ multiplied by its density $\rho_o$ are summed and then divided by the sum of the flows, that is $$\rho_e = \frac{W_i\rho_i + W_o\rho_o}{W_i + W_o}.$$

Figure 3:
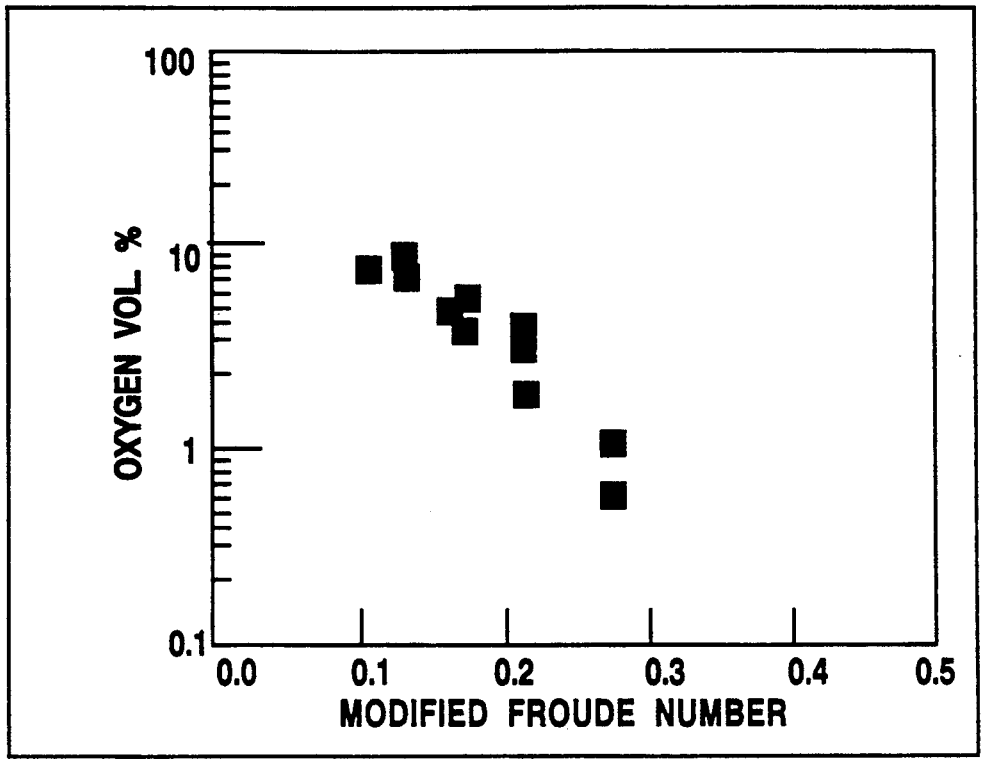
FIG. 3 is a graph of oxygen concentrations in a free furnace volume having an opening protected by a dual layer curtain with varying volumetric rates of flow of an outer layer comprised of nitrogen gas and an inner layer comprised of argon gas, the oxygen concentrations being shown as a function of a composite modified Froude number.

FIG. 3 shows the oxygen content in the free volume of the furnace as a function of a modified Froude number. The oxygen concentration varies from about 10% at a modified Froude number of about 0.1 to about 0.7% at a modified Froude number of about 0.3.

Figure 4:
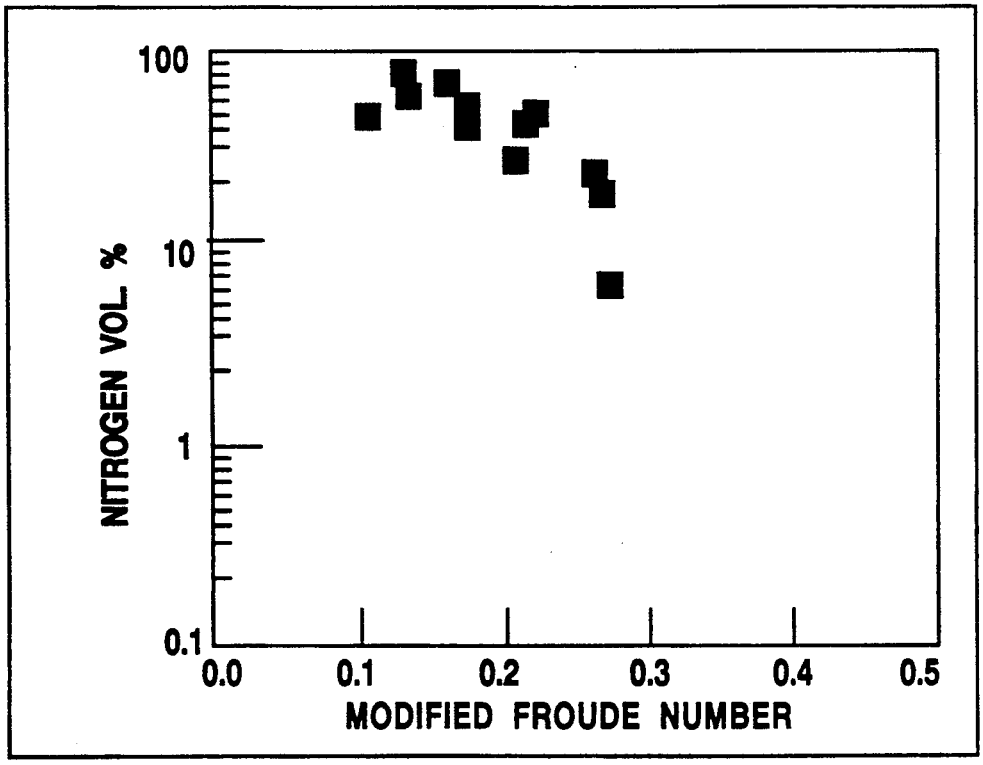
FIG. 4 is a graph of nitrogen concentrations in a free furnace volume having an opening protected by a dual layer curtain with varying volumetric rates of flow of an outer layer comprised of nitrogen gas and an inner layer comprised of argon gas, the nitrogen concentrations being shown as a function of a composite modified Froude number.

For dual diffusers with the inner diffuser emitting argon gas and the outer diffuser emitting nitrogen gas, FIG. 4 shows the corresponding nitrogen concentration in the free volume of the furnace as a function of a modified Froude number. The nitrogen concentration varies from about 79% to about 8% over the modified Froude number range of about 0.1 to about 0.3. Thus the means 19 for controlling the inner layer fluid flow and the means 25 for controlling the outer layer fluid flow are capable of controlling the flows to provide modified Froude numbers in the desired ranges.

For the data in FIG. 3 and FIG. 4, the ratio of nitrogen flow rate to argon flow rate is about 1.5. Lower concentrations of nitrogen at a given oxygen concentration can be achieved within the free volume of the furnace by increasing the flow rate of argon relative to the nitrogen.

Figure 5:
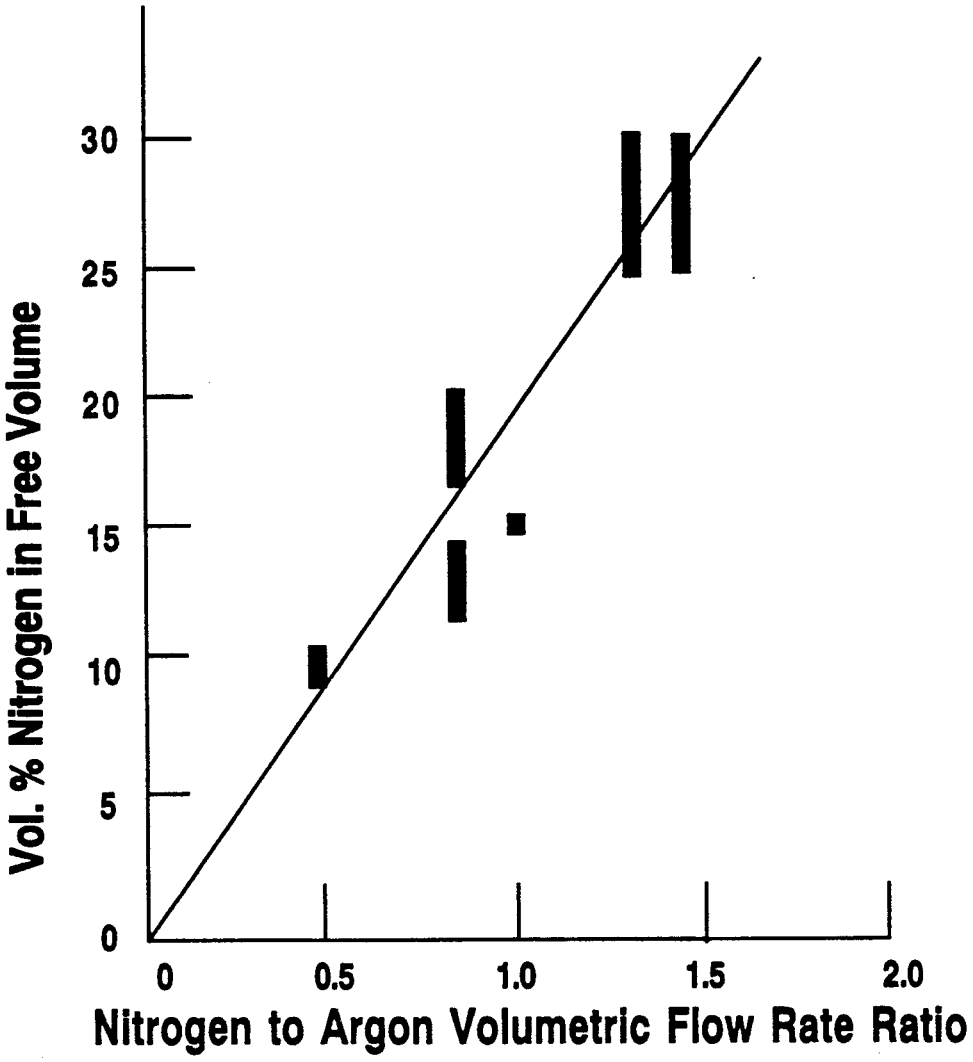
FIG. 5 is a graph of nitrogen concentrations in a free furnace volume maintained at an oxygen concentration of 0.5 to 1% by a dual layer curtain having varying ratios of nitrogen outer layer flow to argon inner layer flow.

FIG. 5 shows how nitrogen concentration may be varied while maintaining an oxygen concentration of 0.5 to 1% in a furnace free volume by varying the ratio of nitrogen flow to argon flow. This capability of adjusting the nitrogen concentration while maintaining a low oxygen concentration allows specific alloy product requirements for oxygen and nitrogen content to be met without changing equipment and with low protective gas costs relative to other methods.

In cases where the inner layer is substantially argon gas and the outer layer is at least 78% by volume nitrogen gas, the volume percent of oxygen in the selected atmosphere will be from about 15 to about 45 times the length over which the dual curtain extends divided by the composite thickness of the curtain at its origin times the natural exponential of minus about 16 times the composite modified Froude number of the curtain.

Correspondingly, the volume percent of nitrogen in the selected atmosphere will be from about 5 to about 15 times the ratio of the volumetric flow rate of the outer layer to the volumetric flow rate of the inner layer, plus from about 55 to about 170 times the length over which the curtain extends divided by the composite thickness of the curtain at its origin times the natural exponential of minus about 16 times the composite modified Froude number of the curtain.

These relationships may be expressed algebraically as:

$$M = a\frac{l}{t}e^{-16F} \quad \text{and}$$

$$N = 3.7\,a\frac{l}{t}e^{-16F} + bR \quad \text{where}$$

a = a coefficient ranging from about 15 to about 45, b = a coefficient ranging from about 5 to about 15, e = 2.718, the base of natural logarithms, F = the composite modified Froude number, l = the distance over which the dual layer curtain extends, t = the composite thickness of the dual layer curtain, M = the volume percent of oxygen in the protected free volume, N = the volume percent of nitrogen in the protected free volume, and R = the ratio of outer layer volumetric flow rate to inner layer volumetric flow rate.

Figure 6:
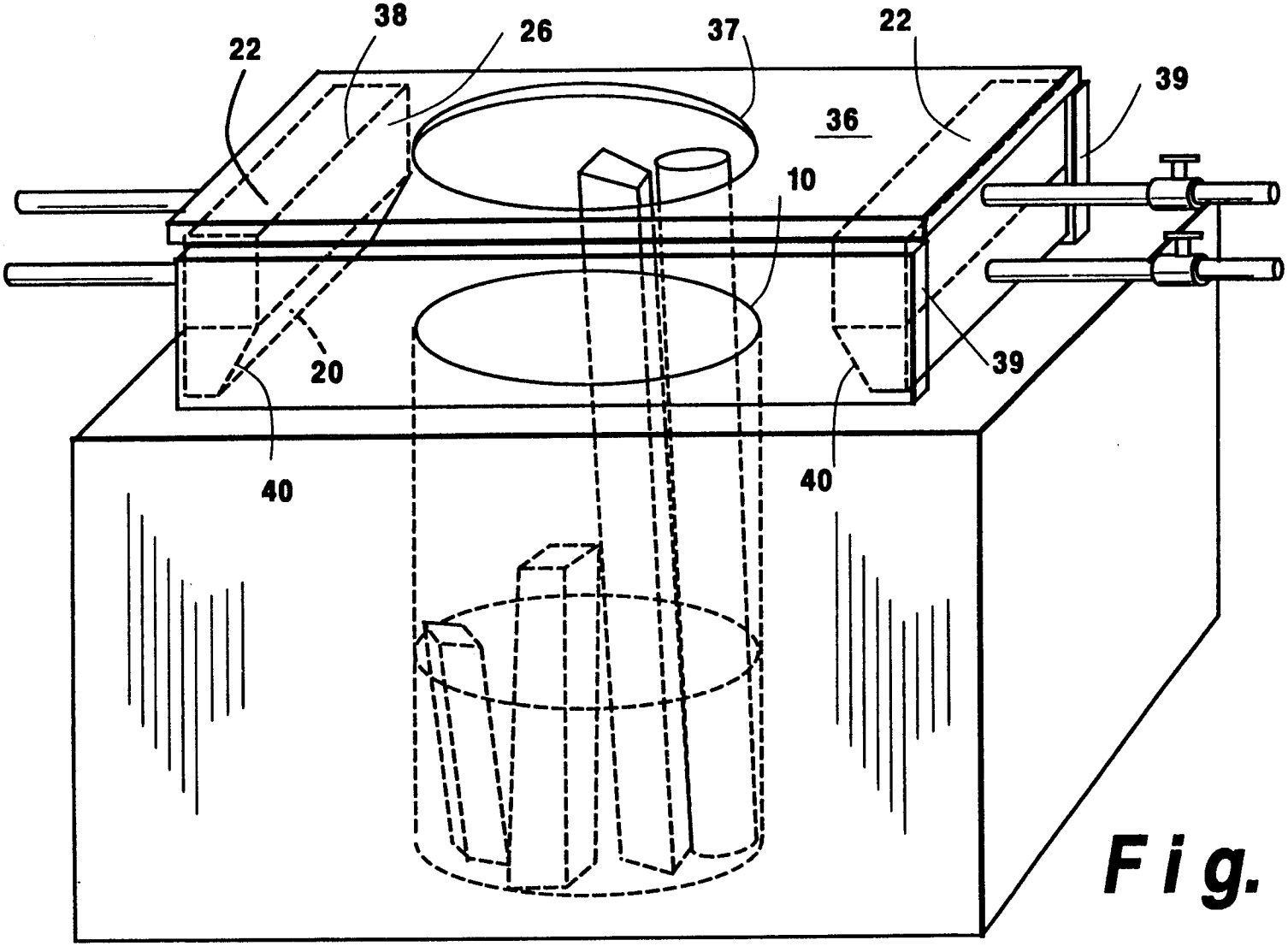
FIG. 6 is a pictorial view of a furnace with other embodiments of the invention.

Another embodiment of the invention includes an outer shield for the outer lateral surface of the outer layer of fluid curtain, that is, the outer surface distal to the plane of the protected opening. The outer shield 36 shown in FIG. 6 is a substantially flat surface or plate across the top of the outer diffusers and having an aperture 37 at least partially coinciding with at least a portion of the furnace opening 10. Thus the furnace opening 10 is at least partially unobstructed. In principle, the outer shield 36 extends approximately from the outer edge 38 of the outer diffuser emitting surface 26 in a direction normal to the emitting surface 26. The outer shield covers a portion of the outer lateral surface of the outer layer of curtain, prevents it from breaking up, and reduces the volumetric flow of gas that is required for emission by the diffusers to form the curtain. The outer shield is equally applicable for a single layer curtain.

The Froude number relationships shown in FIG. 3 and FIG. 4 apply providing the area covered by the curtain is calculated as the area of the aperture in the flat surface covered by the dual layer curtain. The distance over which the curtain extends is taken as the distance the curtain extends over the aperture in the shield. Thus, in FIG. 6, the distance is the radius of the aperture shown.

Another embodiment includes a side shield 39 for a side or side edge of the fluid curtain as shown in FIG. 6. A side shield is a substantially flat surface lying in a plane extending laterally approximately from the side edge 40 of a diffuser emitting surface 20 or 26 in a direction approximately normal to the diffuser emitting surface. It extends at least partially to or beyond the perimeter of the furnace opening 10. In practice, with a pair of diffusers on opposite sides of an opening as shown in FIG. 6, a side shield comprises a substantially flat surface or plate across the side ends of the diffusers.

The construction of the diffusers 16 and 22 depicted in FIG. 1 comprises an elongated box with a porous emitting face 20 and 26. The porous face is preferably a sintered metal sheet with a pore size ranging from about 0.5 microns to about 100 microns and preferably from about 2 microns to about 50 microns.

Figure 7:
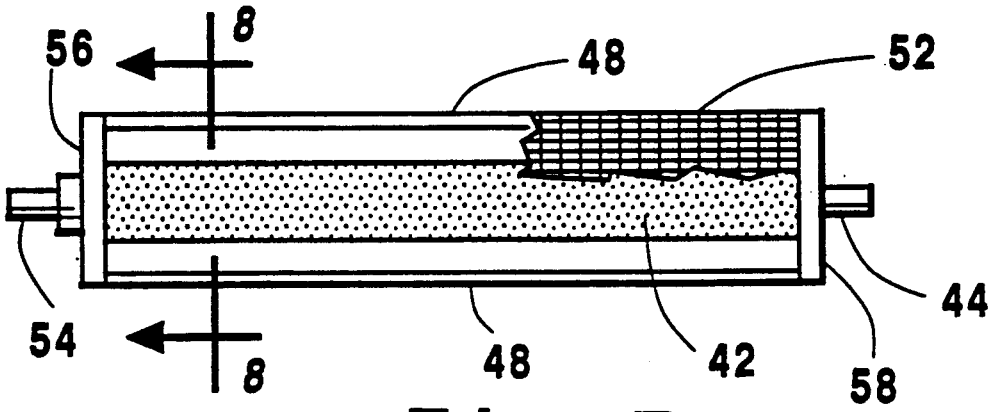
FIG. 7 is longitudinal view of a novel diffuser comprising this invention with the mesh covering the housing opening partially removed.
Figure 8:
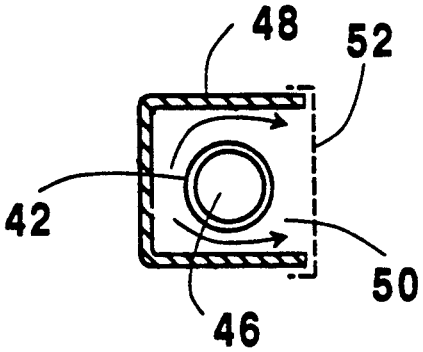
FIG. 8 is a section of the diffuser taken on lines 8—8 of FIG. 7.

Novel constructions for a diffuser to issue a single layer curtain are shown in FIG. 7 and FIG. 8. A hollow tubular body 42 has an inlet 44 for fluid into the hollow 46 and a perforated wall for emitting fluid. The tubular body 42 is contained in a housing or channel 48 having an outlet 50. The housing 48 extends substantially the length of the tubular body 42. The outlet 50 directs a curtain of fluid from the housing 48 across an opening to a volume desired to have a selected atmosphere. The height of the housing outlet 50 is at least 5% of the distance the curtain is intended to extend. A screen 52 across the housing outlet 50 disperses the flow from the housing 48 and protects against metal splatter or splash.

One end of the tubular body 42 preferably has a cylindrical support 54 which passes through and is supported by an end wall 56 of the housing 48. The Other end of the tubular body has the fluid inlet 44 which passes through and is supported by the other end wall 58 of the housing.

The perforations in the tubular body are fine, preferably so that the wall of the tubular body comprises a porous wall. The pore size is from about 0.5 microns to about 100 microns, preferably from about 2 microns to about 50 microns. In operation, flow is controlled to issue from the porous tube in a laminar state with a modified Froude number of from about 0.05 to about 10.

The screen 52 may be any perforated surface which produces little pressure drop and protects the diffuser 42 against molten metal splash. Wire mesh with from 1 to 50 openings per centimeter functions well. The mesh covers the housing outlet 50 and the edges of the mesh bend around the housing without any additional sealing requirement to the housing 48 as shown in FIG. 8. Surprisingly the screen improves the overall performance of the diffusers in excluding air from a protected furnace volume. In addition to mesh, perforated plates and sintered metal surfaces are usable. Any of these surfaces can also be mounted to the housing by common techniques such as flush or inlaid mounting, for example.

Figure 9:
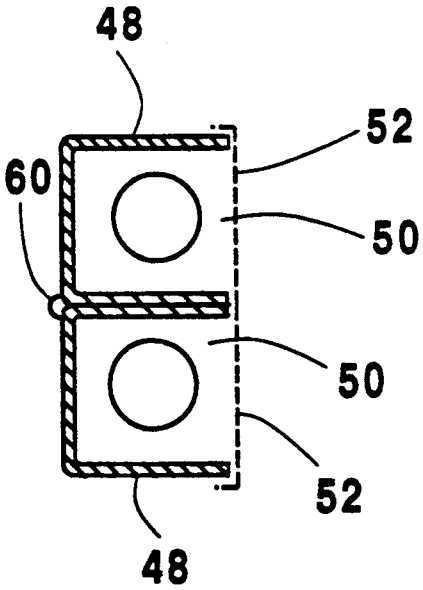
FIG. 9 is a section of two diffusers, of the type shown in FIG. 7 and FIG. 8 assembled to issue a dual layer curtain.
Figure 10:
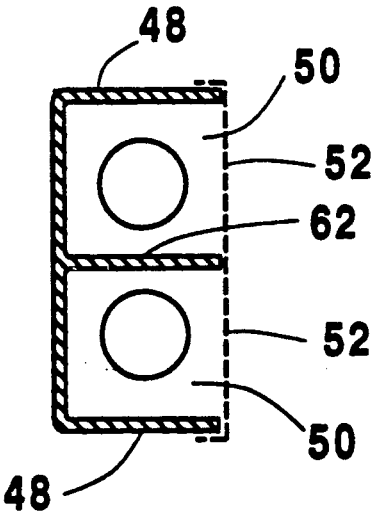
FIG. 10 shows another diffuser configuration to issue a dual layer curtain.

As shown in FIG. 9, two diffusers may be placed with their housings adjacent to each other and aligned to emit fluid to flow in the same approximate direction in two parallel layers. A seal 60 may be included between the diffuser housings to eliminate any air infiltration between the diffusers. Alternatively as shown in FIG. 10, two diffusers may be provided by a single housing with a separator 62. A common screen 52 covers both openings 50 of the housing. The common screen improves the performance of the combination of the two diffusers possibly by reducing the mixing of the layers emanating from each diffuser. While diffusers have been illustrated in the shape of linear segments, a diffuser may be in the shape of an annulus or annular segment, or any shape to match the perimeter of an opening.

COMPARATIVE EXAMPLE I

A commercial metal melting furnace having a capacity of 434 kg of molten metal produces various metal alloys in one series of heats with the furnace opening exposed to the atmosphere. In another series of heats producing the same metal alloys, the furnace opening is provided, in accordance with this invention, a gas curtain having a nitrogen outer layer and an argon inner layer so as to maintain in the furnace free volume volumetric concentrations of approximately 1% oxygen and 25% nitrogen. The volumetric flow rate ratio of nitrogen to argon required is about 1.6.

The oxygen and nitrogen content in the metal product from the air-exposed heats and from the curtain-protected heats are compared in Table I below.

TABLE I

| | Product Content | | | |
|---|---|---|---|---|
| | Nitrogen wt % | | Oxygen wt % | |
| Alloy Type | Air exposed | Curtain protected | Air exposed | Curtain protected |
| CF-8M | 0.055 | 0.050 | 0.019 | 0.010 |
| CK-20 | 0.092 | 0.086 | 0.020 | 0.014 |
| 17-4PH | 0.050 | 0.048 | 0.018 | 0.013 |
| Co-base | 0.091 | 0.068 | 0.031 | 0.017 |
| 8620 | 0.013 | 0.013 | 0.012 | 0.005 |

As intended, the product from the heats protected by the nitrogen-argon curtain has equal, or somewhat less, nitrogen than the product from the heats exposed to air. However, the curtain-protected product has 30 to 60% less oxygen and a superior quality than the air-exposed product. The cost of providing the dual layer, nitrogen-argon curtain is $0.25 per kg of product. The cost for providing a single layer argon curtain achieving the same oxygen content in the product is $0.48 per kg of product, almost twice as much. Thus the dual layer curtain has the advantage of allowing control of the oxygen and nitrogen concentrations independently and provides greater economy than a single layer curtain.

COMPARATIVE EXAMPLE II

A further comparison is presented with respect to the furnace of Example I operated with a protective gas curtain. Table II compares the cost of operating with (1) a single layer curtain of argon; (2) an outer layer of nitrogen and inner layer of argon; and (3) an outer layer of air and inner layer of argon. A common requirement is to maintain the furnace free volume at a concentration of 1% by volume of oxygen and not more than 25% nitrogen. In using a single layer of argon to achieve 1% oxygen, a concentration of 3.7% nitrogen occurs in the furnace free volume. This nitrogen concentration is unnecessarily low, but cannot be altered without altering the oxygen concentration. In using the air and argon layers, a slightly higher modified Froude number is required to achieve the 1% oxygen concentration than is required with the other systems.

TABLE II

| | Single layer curtain Ar | Dual layer curtain $N_2$-Ar | Dual layer curtain Air-Ar |
|---|---|---|---|
| $O_2$ in free furnace volume, | 1 | 1 | 1 |
| $N_2$ in free furnace volume, vol. % | 3.7 | 25 | 3.7 |
| Curtain Froude number | 0.35 | 0.35 | 0.38 |
| Nitrogen diffuser flow, | 0 | 11.3 | 0 |
| Air diffuser flow, | 0 | 0 | 10.3 |
| Air diffuser flow, ltr/sec. at 1 atm, 21° C. | 14.0 | 8.1 | 10.3 |
| Gas cost, $/h4 | 35 | 23 | 26 |

The cost of supplying the gases is taken as $0.070 per 1000 liters of nitrogen, $0.700 per 1000 liters of argon and $0.0052 per 1000 liters of air. In this comparison, the dual layer curtains clearly are more economical than the single layer curtain. The air-argon curtain appears slightly higher in operating cost than the nitrogen-argon curtain. However, an air-argon curtain has an advantage over a nitrogen-argon curtain in that a nitrogen supply facility is obviated by a more convenient, less costly, air supply facility.

COMPARATIVE EXAMPLE III

The performance is compared of three configurations of diffuser, each providing a single layer nitrogen curtain at a modified Froude number of 0.28.

Pairs of longitudinal diffusers of each configuration are sequentially positioned with emitting surfaces 37 centimeters apart across an opening 22.8 centimeters in diameter to a cylindrical volume having no other opening. In all three configurations, each diffuser is 30 centimeters long with an emitting plane or surface 2.5 centimeters high. Configuration 1 is a long box with a flat emitting surface of sintered metal sheet. Configuration 2 is a porous metal tube 1.2 centimeters in diameter centrally housed in a channel of square cross-section with one open face 2.5 centimeters high. Configuration 3 is a duplicate of configuration 2 except that the channel opening is covered by a mesh with 8 openings per centimeter comprised of wire 0.046 centimeters in diameter. The oxygen concentration resulting in the controlled volume is presented in Table III following for each configuration.

TABLE III

| Configuration | % $O_2$ |
|---|---|
| 1. Flat face | 1.5 |
| 2. Sparger-Channel | 3.3 |
| 3. Sparger-channel-mesh | 1.1 |

Configuration 3 provides the best performance in that the lowest oxygen concentration results.

Although the invention has been described with reference to specific embodiments, it will be appreciated that it is intended to cover all modifications and equivalents within the scope of the appended claims.

What is claimed is:

1. An apparatus for providing a selected atmosphere at and within the opening to a contained volume, said apparatus comprising:

(a) an inner diffuser for mounting near at least a portion of the perimeter of the opening to emit an inner layer of fluid curtain to flow over at least a portion of the opening, enter and purge the volume and substantially provide the selected atmosphere at the opening and in the volume;

(b) an outer diffuser for mounting adjacent to said inner diffuser to emit an outer layer of fluid curtain to flow in the same approximate direction as the inner layer and to extend over at least a portion of the inner layer and impede the infiltration of surrounding air into the inner layer;

(c) fluid emitting areas in said inner and outer diffusers to emit fluid laminarly, said emitting areas having a composite height at least 5% of the distance over which said layers are intended to flow;

(d) means for controlling the inner diffuser fluid flow,;

(e) means for controlling the outer diffuser fluid flow; said inner diffuser and said outer diffuser fluid flow control means capable of controlling the fluids to issue at a composite modified Froude number within the range of from about 0.05 to about 10;

(f) a source of inner fluid, said source external to the contained volume and in communication with said inner diffuser; and (g) a source of outer fluid, said source external to the contained volume and in communication with said outer diffuser.

2. The apparatus as in claim 1 wherein said contained volume is the free interior volume of a furnace.

3. The apparatus as in claim 1 wherein each of said diffusers comprises a group of diffusers, the components of each group spatially separated and oriented to emit fluid over the furnace opening towards a common line or point.

4. The apparatus as in claim 1 wherein each of said diffusers comprises at least a portion of an annulus encircling the perimeter of the opening.

5. The apparatus as in claim 1 further comprising:

(h) a middle diffuser mounted between said inner diffuser and said outer diffuser to emit a middle layer of fluid to flow in the same approximate direction as the inner layer, said middle diffuser having a surface to emit fluid laminarly;

(i) means for controlling the middle diffuser fluid flow; and (k) a source of middle fluid, said source external to the contained volume and in communication with said middle diffuser.

6. The apparatus as in claim 1 including an outer shield for the outer lateral surface of the outer curtain layer, said outer shield comprising a substantially flat surface extending approximately from the flat outer edge of the outer diffuser emitting surface towards the opening and having an aperture partially coinciding with at least a portion of the opening.

7. The apparatus as in claim 1 including a side shield for a side of the fluid curtain, said side shield comprising a surface at least partially extending approximately from the side edge of a diffuser emitting surface, up to or beyond the perimeter of the opening.

8. The apparatus as in claim 1 wherein at least one of said diffusers and said fluid flow control means is designed to emit a layer having a modified Froude number in the range of about 0.05 to about 10.

9. The apparatus as in claim 1 wherein at least one of said diffusers and said fluid flow control means is designed to emit a layer having a modified Froude number in the range of about 0.1 to about 2.

10. The apparatus as in claim 1 further comprising means for sealing against the incursion of air between said inner and outer diffusers and between said inner diffuser and the surface containing the opening.

11. The apparatus as in claim 1 wherein at least one of said diffusers is oriented to emit flow parallel to the opening.

12. The apparatus as in claim 1 wherein at least one of said diffusers is oriented to emit flow at an acute angle relative to the opening.

13. The apparatus as in claim 1 wherein said inner diffuser is oriented so as to emit flow at an acute angle into the opening.

14. The apparatus as in claim 1 wherein said source of inner fluid contains a gas selected from the group consisting of argon, helium, hydrogen, nitrogen, carbon dioxide, carbon monoxide and mixtures thereof.

15. The apparatus as in claim 1 wherein said source of inner fluid contains substantially argon and said source of outer fluid contains at least 78% nitrogen.

16. The apparatus as in claim 1 wherein said source of inner fluid contains a gas comprised of at least 78% nitrogen and the volume percent of oxygen in said selected atmosphere is from about 15 to about 45 times the length over which said curtain extends divided by the composite thickness of said curtain at its origin times the natural exponential of minus about 16 times the composite modified Froude number of said curtain.

17. The apparatus as in claim 1 wherein said source of inner fluid contains a gas comprised substantially or argon and said source of outer fluid contains a gas comprised of at least 78% nitrogen and the volume percent of nitrogen in said selected atmosphere is from about 5 to about 15 times the ratio of the volumetric flow rate of said outer layer to the volumetric flow rate of said inner layer plus from about 55 to about 170 times the length over which said curtain extends divided by the composite heights of said emitting areas times the natural exponential of minus about 16 times the composite modified Froude number of said curtain.

18. The apparatus as in claim 1 wherein the ratio of said fluid emitting areas of said outer to inner diffusers is capable of emitting a volumetric ratio of flow in said outer layer to said inner layer in the range of about 0.05 to about 3.

19. The apparatus as in claim 1 wherein said fluid emitting areas are porous, permeable or perforated surfaces.

20. An improved furnace for processing a work charge in a selected atmosphere, said furnace comprising:

(a) a body having an interior volume with an opening to the surrounding atmosphere for the introduction of the work charge;

(b) an inner diffuser mounted near at least a portion of said opening, to emit an inner layer of fluid flow so as to flow over at least a portion of said opening, enter and purge any free volume of said furnace and substantially provide the selected atmosphere at said opening and in any free volume;

(c) an outer diffuser mounted on said inner diffuser and said furnace opening to emit an outer layer of another fluid to flow in the same approximate direction as the inner layer and to extend over at least a portion of the inner layer thereby impeding the infiltration of surrounding air into the inner layer;

(d) fluid emitting areas in said inner and outer diffusers to emit fluid laminarly, said emitting areas having a composite height at least 5% of the distance over which said layers are intended to flow;

(e) means for controlling the inner diffuser fluid flow,;

(f) means for controlling the outer diffuser fluid flow; said inner diffuser and said outer diffuser flow control means capable of controlling the fluids to issue at a composite modified Froude number within the range of from about 0.05 to about 10;

(g) a source of inner fluid, said source external to said free volume and in communication with said inner diffuser; and (h) a source of outer fluid, said source external to said free volume and in communication with said outer diffuser; and (i) said apparatus being devoid of a suction device adjacent to the perimeter of the opening for removing fluid from the curtain.

21. The furnace as in claim 20 further comprising an outer shield for covering the outer lateral surface of at least a portion of the outer layer, said outer shield having an opening at least partially coinciding with at least a portion of said furnace opening.

22. The furnace as in claim 20 further including a side shield for at least a portion of a side of at least one of said fluid layers.

23. A diffuser for emitting a laminar fluid curtain across an opening to a contained volume, said diffuser comprising:

(a) a hollow tubular body having an inlet for fluid and a porous wall for emitting fluid in laminar flow, said porous wall having a pore size of from about 0.5 micrometers to about 100 micrometers;

(b) a housing enclosing said perforated body and having an outlet extending substantially the length of said tubular body, said outlet for directing fluid from said housing across the opening to the volume; and (c) a screen across said housing outlet for dispersing the flow from said housing and for protecting said perforated body, said screen having a mesh size of from about 1 to about 50 openings per centimeter.

24. The diffuser as in claim 23 wherein said outlet for directing fluid has a height at least 5% of the distance over which the curtain is intended to flow.

25. The diffuser as in claim 23 wherein said perforated wall is a porous wall having a pore size of about 2 microns to about 50 microns.

26. The diffuser as in claim 23 wherein said diffuser comprises two diffusers with their housings adjacent to each other and aligned to emit fluid to flow in the same approximate direction over the opening.

27. The diffuser as in claim 23 wherein said diffuser is in the shape of a linear segment.

28. The diffuser as in claim 23 wherein at least a portion of said diffuser is in the shape of an annulus or annular segment.

* * * * *